United States Patent [19]

Buschor et al.

[11] 4,066,041

[45] Jan. 3, 1978

[54] APPARATUS FOR ELECTROSTATICALLY APPLYING COATING MATERIAL TO ARTICLES AND THE LIKE

[75] Inventors: Karl Buschor; Peter Ribnitz, both of St. Gallen, Switzerland

[73] Assignee: Gema AG Apparatebau

[21] Appl. No.: 672,955

[22] Filed: Apr. 2, 1976

[30] Foreign Application Priority Data

Apr. 11, 1975 Switzerland ..... 4661/75

[51] Int. Cl.[2] ..... B05B 5/02

[52] U.S. Cl. ..... 118/629; 239/15

[58] Field of Search ..... 118/621, 627, 629, 630, 118/625; 239/3, 15

[56] References Cited

U.S. PATENT DOCUMENTS

| | | | |
|---|---|---|---|
| 3,169,882 | 2/1965 | Juvinall et al. | 239/15 X |
| 3,169,883 | 2/1965 | Juvinall | 239/3 X |
| 3,195,819 | 7/1965 | Watanabe | 239/15 X |
| 3,637,135 | 1/1972 | Luderer et al. | 118/621 X |
| 3,682,384 | 8/1972 | Suisse | 239/15 |
| 3,938,740 | 2/1976 | Bertilsson et al. | 239/3 X |
| 3,951,340 | 4/1976 | Point | 239/3 |

FOREIGN PATENT DOCUMENTS

| | | | |
|---|---|---|---|
| 569,700 | 1/1959 | Canada | 239/3 |
| 1,188,682 | 4/1970 | United Kingdom | 118/621 |

*Primary Examiner*—Mervin Stein
*Attorney, Agent, or Firm*—Karl W. Flocks

[57] ABSTRACT

An apparatus for the electrostatic application of a coating material in the form of a liquid to articles or the like comprising a nozzle at the region of which there are provided at least two electrodes at which there is applied high-voltage of the same polarity but of different magnitude. The electrical field between the electrodes covers the nozzle opening in the form of a transverse field.

4 Claims, 4 Drawing Figures

APPARATUS FOR ELECTROSTATICALLY APPLYING COATING MATERIAL TO ARTICLES AND THE LIKE

BACKGROUND OF THE INVENTION

The present invention relates to a new and improved construction of apparatus for the electrostatic application of coating material to articles, the coating material being present in the form of a liquid. The electrostatic coating apparatus of the invention is of the type comprising a nozzle arranged at the outlet opening of an infeed conduit formed of electrically insulating material, the nozzle serving for the atomization, without air, of the coating material which is under pressure. Further, there is provided an electrode arrangement to which there is applied a high-voltage for the electrostatic charging of the coating material and for maintaining an electrical field for the transport of the charged material particles to the article to be coated.

The unsatisfactory efficiency of older devices of this type wherein, for instance, there was arranged a rim of needle electrodes to which there was applied a high-voltage about the nozzle, could be improved, for instance as described in German patent 1,291,659 in that at the lengthwise side of a flat jet nozzle at the direct neighborhood of the spray jet there was provided a single electrode to which there was applied a high-voltage, especially an electrode in the form of a thin wire directed parallel to the spray jet axis. With this apparatus the grounded metallic handgrip serves as the counter electrode for the single high-voltage electrode. This metallic handgrip— viewed in the coating or spraying direction—is located in front of the nozzle and has a relatively small spacing from the high-voltage electrode, so that the mean or average potential gradient of the field between electrode and handgrip is greater then the mean potential gradient between the electrode and the grounded article to be coated. Consequently, the electrical charging of the atomized material is essentially independent of the potential gradients which vary as a function of the spacing of the article from the electrode and dependent upon the practically constant potential gradient of the reverse field between the electrode and the handgrip. In order to obtain a uniform coating operation there is required a minimum spacing of the article from the coating device, which generally amounts to 20 to 25 centimeters, and additionally, for the guiding of the charged material particles there is necessary a sufficiently intense transport field which requires the application of a higher high-voltage of for instance 70 kV and more at the electrode. This leads to difficulties as concerns the reverse field decisive for charging. Moreover, attaining an improved charging by means of a reverse field which is more intense relative to the transport field is already problematic in terms of the safety of the operator of the coating apparatus and the generally existing relevant regulations concerning maintaining minimum spacing of the reverse field do not permit an intensity which is necessary for optimum charging of the material, so that the improvement in the efficiency which can be realized in fact with a reverse field is confined within rather narrow limits.

SUMMARY OF THE INVENTION

Hence, it is a primary object of the present invention to provide an improved construction of apparatus for the electrostatic application of coating material to articles or the like in a manner not associated with the aforementioned drawbacks and limitations of the prior art proposals.

Another and more specific object of the present invention aims at the provision of a novel coating apparatus of the previously mentioned type which provides an increased efficiency over the correspondingly known coating apparatuses of the prior art while also providing increased operational safety and improved charging of the coating material.

Now in order to implement these and still further objects of the invention, which will become more readily apparent as the description proceeds, the apparatus of the invention contemplates the provision of at least two electrodes at the region of the nozzle, there being applied to such electrodes high-voltage of the same polarity but of different magnitude. The electrical field prevailing between the electrodes covers the nozzle opening in the form of a transverse field. Hence, for the charging of the coating material effluxing from the nozzle there is essentially decisive the potential gradient of the transverse field which, with relatively small mutual spacing of the electrodes, can be very high even in the presence of small potential differences since the intensity of the transverse field can be chosen almost up to the disruptive field strength without impairing the operational safety, and the distance or deviation from such disruptive field strength can be selected for safety reasons as a function of the inflammability of the coating material. Due to the small electrode spacing and the potential difference which is low in relation to the applied high-voltage there is produced an intense and undisturbed transport field which corresponds to that of a single replacement or reserve electrode.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 4*a* illustrates a coating device with two needle electrodes, FIG. 4*b* a coating device with three needle electrodes, and FIG. 4*c* a coating device with four needle electrodes.

DETAILED DESCRIPTION OF THE INVENTION

Figure 1:
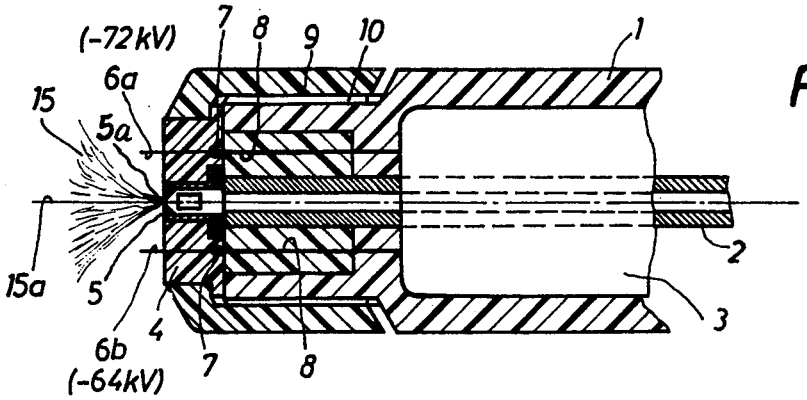
FIG. 1 schematically illustrates a longitudinal sectional view, from the top, of the forward portion of a coating device or apparatus designed according to the invention.

Describing now the drawings, the coating apparatus or device shown in the drawings can be constructed, for instance, as usual in the form of a spray gun. The gun body 1 (FIG. 1) contains a plastic pipe or tube 2 which extends from the end surface of the gun body rearwardly to the not particularly illustrated handgrip where it is connected with a pressure line for the infeed of, for instance, liquid coating material, such as for example lacquer or varnish. In order to generate the high-voltage there are arranged upon the plastic tube 2, for instance the recitifier means, capacitors and possibly also the resistors of a high-voltage cascade, generally designated in its entirety by reference character 3 in FIG. 1, as such has been described in detail for instance in Swiss patent 496,481, to which reference may be readily had and the disclosure of which is incorporated herein by reference. The cascade 3 is molded in the pistol body 1 formed of plastic. The supply of the high-voltage cascade 3 occurs preferably through the agency of a high-frequency generator which is accommodated in the handle or handgrip.

At the end face of the spray gun body 1 there is located a front plate 4 formed of plastic. This front plate 4 is pressed and fixedly held at its end face against the end face of the gun body 1 by means of a retaining nut or cap screw 9 threaded onto the external threading 10 of such gun body 1. In the front plate 4 there is inserted coaxially with respect to the plastic tube 2 and at the outlet end thereof a nozzle 5 for airless atomization, a so-called Airless-nozzle of convenational construction. Protruding out of the front plate 4 are two substantially needle-shaped electrodes 6*a* and 6*b* which are formed for instance of thin tungsten wire and are situated diametrically opposite one another and have the same spacing from the nozzle 5. The electrodes 6*a* and 6*b* are connected via the terminals 7 and the conductors 8 with outputs of the high-voltage cascade 3, by means of which there is applied to the one electrode 6*a* a high potential of, for instance, −72 kV and at the other electrode 6*a* a lower potential of, for instance, −64 kV. Instead of applying negative potential to the electrodes it would be possible to also apply positive potential, depending upon which polarity is more favorable for the coating material to be atomized and charged.

The electrical field which is governed by the potential difference of both electrodes 6*a* and 6*b* extends transversely over the opening 5*a* of the nozzle 5. With the aforementioned potential difference of 8 kV and an electrode spacing of 13 millimeters there is accordingly obtained a transverse field with a mean potential gradient of approximately 6 kV/cm, by means of which even in the case of poorly chargeable coating materials there can be realized charging of the material particles to a degree adequate for carrying out an effective coating operation. With a conventional minimum spacing of the article to be coated from the nozzle of, for instance, 25 centimeters both of the electrodes 6*a* and 6*b* do not have a disturbing effect upon the shape of the transport field due to the relatively small spacing from one another and the relatively low potential difference of 8 kV. With the numerical example under discussion the transport field has a mean or average potential gradient of approximately 2.7 kV/cm. The coating apparatus will possess grounded metallic parts at the region of the handgrip or handle, which form a counter-electrode for the electrodes 6*a* and 6*b* to which there is applied the high-voltage, so that also with this electrode arrangement there is present a reverse field. This reverse field is however not decisive for the electrical charging of the coating material, so that for the electrode arrangement 6*a*, 6*b* there can be provided a sufficiently great distance from the grounded metal parts, especially a distance corresponding to the valid prevailing regulations concerning minimum spacing.

With the exemplary embodiment of FIG. 1 the electrodes 6*a* and 6*b* are constituted by thin wires which extend forwardly from the front plate 4 and parallel to the axis 15*a* of the spray jet 15, and therefore these thin wires if the equipment is not carefully handled can be easily bent, damaged or broken-off, and especially further can be contaminated by coating material which deposits thereon, with a result that there is an impairment of the charging of the coating material in the transverse field. In order to avoid such the electrodes are protected against mechanical effects by a protection or protective wall, by means of which there is also rendered difficult deposition of atomized coating material upon the electrodes.

Figure 2:
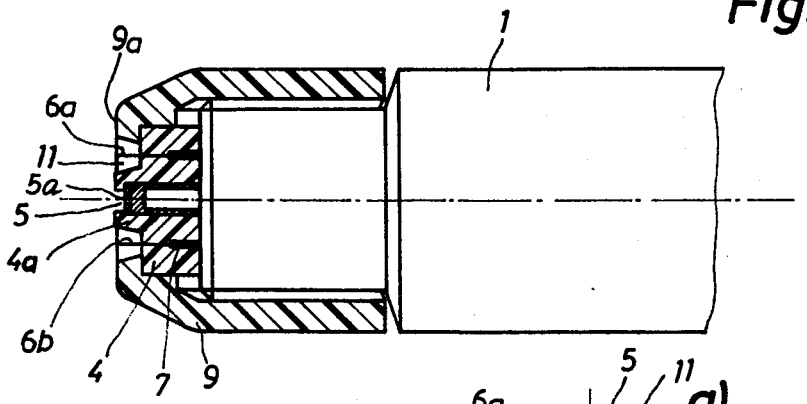
FIG. 2 is a longitudinal sectional view through the forward portion of a coating device having protected electrodes.

FIG. 2 illustrates an exemplary construction of a coating apparatus or device having electrodes protected in the manner discussed above. The protective wall for the electrodes 6*a* and 6*b* in this case is formed by the edge 9*a* of the retaining nut or cap screw 9. The edge 9*a* engages over the front plate 4, as shown. The front plate 4 is provided at its end face with a projection 4*a*, for instance of conical configuration. This projection or extension 4*a* surrounds the outlet opening 5*a* of the nozzle 5 and its base diameter is smaller than the inner diameter of the edge 9*a* of the retaining nut or cap screw 9, so that between the projection 4*a* and the retaining nut-edge 9*a* there is present a forwardly open substantially ring-shaped space 11 into which protrude the electrodes 6*a* and 6*b*. The electrodes 6*a* and 6*b* disposed in the narrow and relatively deep ring-shaped electrodes space or compartment 11 are thus extensively protected against damage and are also less susceptible to becoming contaminated since it is hardly possible for coating material to penetrate into such electrode space. Instead of this construction as just described it would also be possible for the ring-shaped electrode space 11 to be formed itself in the front plate 4 or there can be provided for each electrode a separate electrode space 16 (FIG. 4*b*) which is formed in the front plate 4. The formation of the electrode space 11 with the aid of the retaining nut 9 however has the advantage that cleaning is facilitated.

Figure 3:
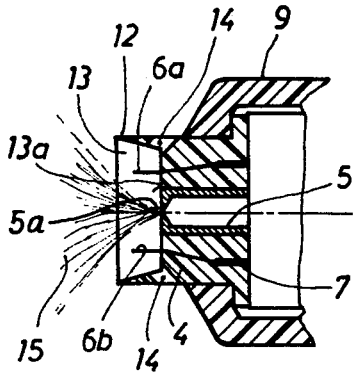
FIG. 3 is a longitudinal sectional view through the forward portion of a coating device with protected electrodes according to a modified constructional embodiment in contrast to the showing of FIG. 2.

A further constructional embodiment of a coating apparatus with protected electrodes has been portrayed in FIG. 3. With this embodiment the front plate 4 carries at its end face as the protective wall for the electrodes 6*a* and 6*b* a protruding edge or skirt 12, for instance of circular configuration, the height and diameter of which are chosen such that the spray jet 15 formed of the atomized coating material can freely escape. The edge or skirt 12 encloses the electrode space 13, at the floor 13*a* of which there is located the outlet opening 5*a* of the nozzle 5, so that the electrodes 6*a* and 6*b* which protrude into the electrode space 13 extend past the nozzle 5 with their entire free length. Lateral openings 14 are advantageously provided in the edge 12 forming the protective wall at the region of the electrodes 6*a* and 6*b*, air flowing-in through such openings 14 so that the electrodes are located in an air current during operation. Consequently, due to the action of the air current the electrodes remain clean for a longer operating time.

Figure 4:
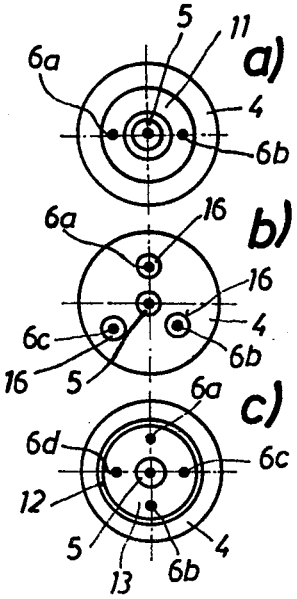
FIGS. 4*a*, 4*b* and 4*c* illustrate three different electrode arrangements of the coating device, and specifically.

In FIGS. 4*a*, 4*b* and 4*c* there have been shown in schematic front view three different electrode arrangements purely by way of example. Thus, FIG. 4*a* shows the previously extensively discussed electrode arrangement where there are provided two diametrically oppositely situated electrodes 6*a*, 6*b* located in a horizontal plane, and wherein these electrodes are arranged in the ring-shaped electrode space 11 to protect them against becoming damaged and contaminated.

FIG. 4*b* illustrates an electrode arrangement having three electrodes 6*a*, 6*b*, 6*c* which are arranged circularly about the nozzle 5 at the corners or apices of an equilateral triangle and of which, for instance, each is located in a separate conical electrode space 16. At all of the electrodes 6*a*, 6*b*, 6*c* there is applied the high-voltage of the same polarity. In order to produce the transverse field the electrodes can possess in different ways different potentials. Thus, the potentials for the three electrodes 6*a*, 6*b*, 6*c* can be stepped with the same but also irregular step differences, or there can be applied to two electrodes the same potential magnitude and at the third electrode a higher or lower potential. The same conditions prevail with the electrode arrangement of FIG. 4*c* where four electrodes 6*a*, 6*b*, 6*c*, 6*d* are arranged, for instance, like in FIG. 3 in a common electrode space 13. With this embodiment the electrodes can also be applied in pairs to respective potentials of different magnitude.

It should be understood that random variations can be made as regards the number and arrangement of the electrodes as well as also the potentials of different magnitude applied thereto of the same polarity, provided only that the transverse field has a sufficiently great potential gradient to insure for a good charging of the momentarily employed coating material. Generally, it is however adequate to only use two electrodes.

The coating apparatus shown in FIG. 1, where the nozzle 5 is arranged at the front end of a plastic tube or pipe 2, serves to atomize a liquid coating material which is delivered under pressure to the nozzle 5. The coating apparatus of course can also be constructed for mixing and at the same time atomizing and charging a number of coating materials. In this case the coating materials are delivered to the nozzle, for instance with the aid of parallel or concentric channels. What is important is the previously discussed transverse field which owing to the variation possibilities as concerns the construction and arrangement of the electrodes and the potentials applied thereat, can be optimumly accommodated to the charging capability of the momentarily employed coating material, whereby to insure for a long disturbance-free operating time the electrodes can be easily and without any additional expenditure protected against damage and contamination. The relevant selected construction of the electrode protection arrangement can be accommodated to the properties of the coating material. Thus, for instance, in the case of coating materials which at most only cause slight contamination of the electrodes, such electrodes then can be completely embedded in plastic in a manner that only their tips are left free.

While there are shown and described present preferred embodiments of the invention, it is to be distinctly understood that the invention is not limited thereto, but may be otherwise variously embodied and practiced within the scope of the following claims. Accordingly,

What is claimed is:

1. An apparatus for electrostatically applying coating materials to articles, comprising infeed means for delivering the coating material, means for the airless atomization of the coating material including a nozzle cooperating with said infeed means, an electrode arrangement to which there is applied high-voltage for electrically charging the coating material and for maintaining an electrical field for the transport of the charged material particles of the coating material to the article to be coated, said electrode arrangement comprising at least two electrodes arranged at the region of said nozzle having means connected thereto for applying a high-voltage of the same polarity but different magnitudes to said electrodes, said nozzle having a nozzle opening, and the electrical field between said electrodes covering said nozzle opening in the form of a transverse field, said electrodes comprising wires extending substantially parallel to the axis of the spraying jet of the coating material applied to the article, said wires possessing essentially the same spacing from said nozzle opening.

2. The apparatus as defined in claim 1, further including means defining a protective wall formed of electrically insulating material for protecting said electrodes against mechanical damage, said protective wall means also rendering difficult deposition of atomized coating material upon said electrodes and formed as spaced openings in a front plate over said nozzle.

3. The apparatus as defined in claim 2, wherein said protective wall means comprises means forming a substantially ring-shaped electrode space surrounding said nozzle, said electrodes being arranged in said ring-shaped electrode space means.

4. The apparatus as defined in claim 2, wherein said protective wall means defines a common protective wall surrounding said electrodes and protruding past said nozzle, said protective wall means including means providing an electrode space for said electrodes, said protective wall means being provided at the region of said electrodes with lateral openings for the infeed of air into said electrode space means.

* * * * *